US005562249A

United States Patent [19]

Trotter

[11] Patent Number: 5,562,249

[45] Date of Patent: Oct. 8, 1996

[54] FLOOD WASHING SYSTEM

[76] Inventor: Stephen G. Trotter, 67 Bailey St., Timboon, 3268, Victoria, Australia

[21] Appl. No.: 409,081

[22] Filed: Mar. 22, 1995

[51] Int. Cl.[6] ..... B05B 1/14

[52] U.S. Cl. ..... 239/1; 239/590.5; 134/42

[58] Field of Search ..... 134/22.12, 22.18, 134/42; 239/590.5, 553.5, 176, 172, 148, 1, 11

[56] References Cited

U.S. PATENT DOCUMENTS

| | | | |
|---|---|---|---|
| 2,684,690 | 7/1954 | Lee | 239/590.5 X |
| 2,898,939 | 8/1959 | Fox | 239/590.5 X |
| 3,174,652 | 3/1965 | Villemure | 239/553.5 X |
| 3,199,875 | 8/1965 | Dabelle | 239/176 |
| 3,544,011 | 3/1968 | Van der Lely | 239/176 X |
| 4,694,991 | 9/1987 | Breckenridge | 239/176 X |

FOREIGN PATENT DOCUMENTS

| | | | |
|---|---|---|---|
| 695417 | 12/1927 | France | 239/176 |
| 267754 | 11/1913 | Germany | 239/553.5 |

*Primary Examiner*—Kevin Weldon

*Attorney, Agent, or Firm*—Cushman Darby & Cushman, L.L.P.

[57] ABSTRACT

A nozzle for use in a flood washing system for flood washing a yard, the system including a tank, downpipe, valve and a distribution nozzle which is located at the bottom of the downpipe and having a plurality of baffles which are adjustable in position so as to produce a controlled fluid output from the nozzle so that the fluid flows substantially across the entire surface of the yard.

11 Claims, 4 Drawing Sheets

FLOOD WASHING SYSTEM

FIELD OF THE INVENTION

This invention relates to a flood washing system.

More particularly, the invention relates to a flood washing system for flood washing a yard such as a dairy yard.

DESCRIPTION OF RELATED ART

Flood washing systems for washing dairy yards are known. In some systems, a large tank is mounted adjacent to the yard and arranged to be tipped over so as to spill the water into the yard. These systems are not particularly effective because there is little control over the direction of water flow. Another system has been developed on a limited scale which utilised a fixed tank fitted with a valve and a large diameter outlet pipe located adjacent to the yard. Baffles were fixed in the end of the outlet pipe so as to afford some measure of control over the direction of discharging water. A serious drawback with this arrangement is that it is usually necessary to make adjustments to the baffles so as to achieve optimum performance. Because the baffles were mounted directly in the end of the outlet pipe which was circular in cross-section, new baffles had to be made and fitted when the orientation was needed to be changed. Accordingly, there is a need for a system in which the baffles can be placed in different orientations.

In accordance with a first aspect of the invention this drawback is solved by providing a nozzle for the outlet of the pipe, the nozzle having a shape whereby the baffles can be placed at different locations therein.

It is usually necessary to make changes to the positions of the baffles during the installation process so as to fine tune the performance of the system to each yard. This can be very time consuming where the baffles are fixed in the nozzle because they need to be removed and refixed by welding or the like. It normally takes a substantial period for the tank to be refilled so that the installer may need to visit a site on a number of different occasions to correctly mount the baffles. This can contribute significantly in the overall installation time.

SUMMARY OF THE INVENTION

Another object of the invention is to overcome this drawback by enabling the farmer or user to make adjustments himself without the need for the manufacturer to visit the site to make final adjustments in the baffle positions. This is accomplished by providing a nozzle in which the baffles are adjustable in position. With this system, the farmer or user can readily make adjustments to the baffle positions in order to optimise performance.

A further object of the invention is to provide a method of rapidly flood washing a yard.

According to the present invention there is provided a method of flood washing a yard comprising the steps of releasing a flushing liquid from storage means so that the liquid flows to outlet nozzle means at a substantial flow rate, adjusting at least one baffle in the nozzle means so that flushing liquid issues from the nozzle means in a controlled way so that the flushing liquid flows substantially across the entire surface of the yard.

In an alternative arrangement, a number of separate nozzles may be provided so as to provide separate streams of flushing fluid which together would cover substantially the whole surface of the yard.

The invention also provides a nozzle for flood washing a surface or yard, the nozzle including inlet means for connection to flushing liquid storage means, outlet means from which the flushing liquid flows, at least one baffle in the outlet means for controlling the direction at which the flushing liquid flows from the outlet means, and wherein the shape of said at least one baffle and the outlet means is such that the baffle can be mounted in different positions in the outlet means.

BRIEF DESCRIPTION OF THE DRAWINGS

The invention will now be further described with reference to the accompanying drawings, in which.

DESCRIPTION OF THE PREFERRED EMBODIMENT(S)

Figure 1:
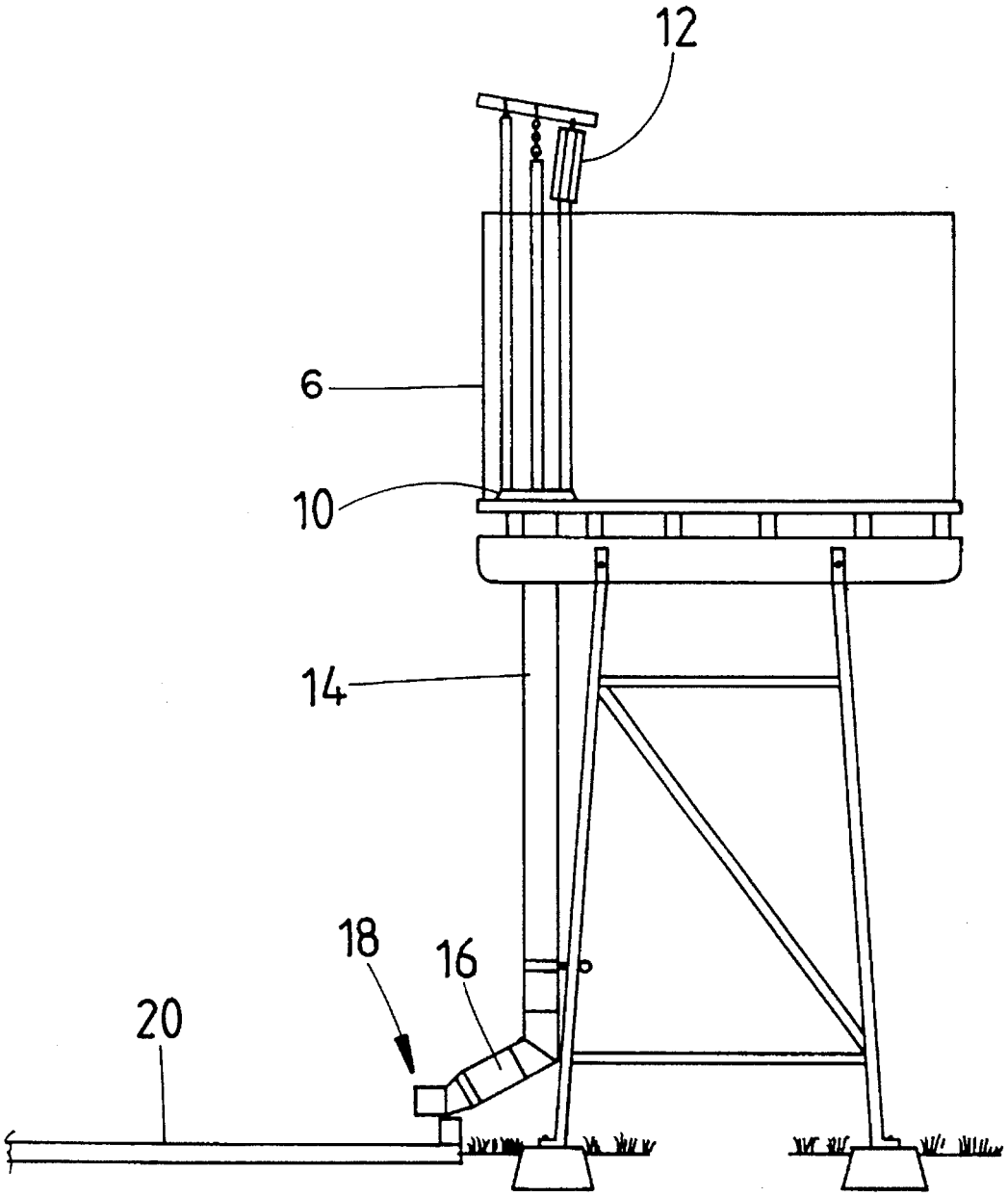
FIG. 1 is a side view of a flood washing system of the invention.
Figure 2:
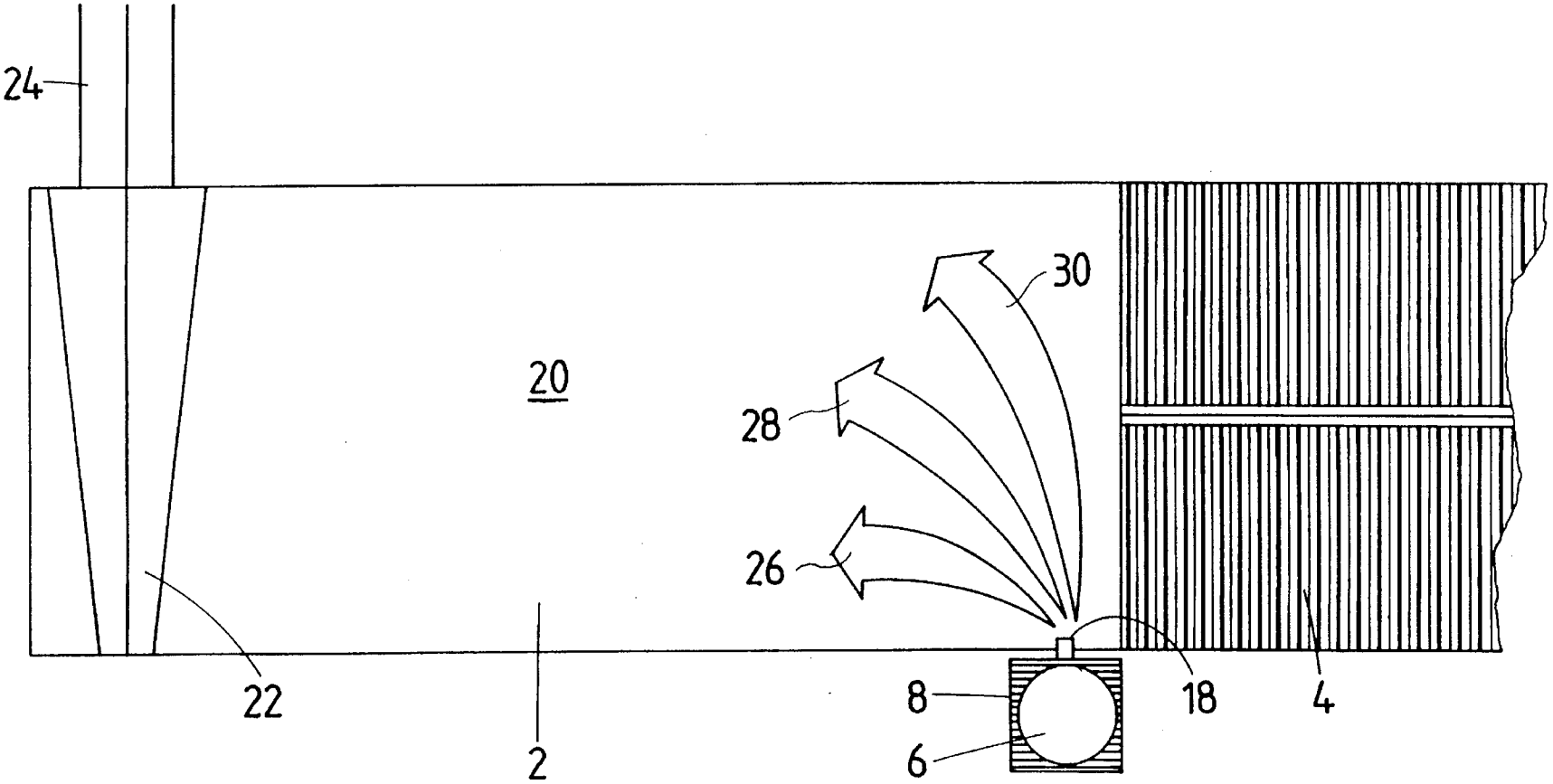
FIG. 2 is a plan view of the flood washing system.

The flood washing system of the invention is particularly useful in flood washing diary yards. FIGS. 1 and 2 show a dairy yard 2 located adjacent to a milking shed 4. Cows (not shown) are held in the yard prior to milking in the shed. The flood washing system of the invention rapidly cleans the excrement from the yard after the cows have vacated the yard.

The flood washing system includes a water tank 6 mounted on a tower 8 which is located adjacent to the yard 2. The tank 6 includes an outlet valve 10 which is operated by an actuating ram 12 (as seen in FIG. 1). A downpipe 14 is connected to the bottom of the tank so as to receive water therefrom when the valve 10 is opened. The downpipe 14 includes a lateral branch 16 which is connected to a distribution nozzle 18 in accordance with the invention. The distribution nozzle 18 is constructed in such a way that it produces a flow pattern which is such that substantially the whole surface 20 of the yard 2 is washed by the water issuing from the nozzle 18.

As best seen in FIG. 2, the nozzle 18 is located near one end of the yard 2 and the surface 20 is such that there is a slope of between 3% and 5% to a V-drain 22 at the opposite end of the yard. Water from the V-drain 22 flows to a channel 24 to a waste collection pond (not shown) or the like. Preferably there is no fall across the yard.

In order for the surface 20 of the yard to be rapidly and thoroughly cleaned, it is necessary that there be a substantial flow rate of water from the nozzle 18. The optimum flow rate for a particular application would depend on a number of factors including the size of the yard, shape of the yard and the relative location of the nozzle 18. In a typical system, the tank 6 may have a capacity from 9,000 to 18,000 liters and the valve 10, downpipe 14 and nozzle 18 are constructed such that the contents of the tank are discharged through the nozzle in about 20 seconds. That is to say, in a typical application there would be a flow rate through the nozzle of at least 25,000 liters per minute.

In accordance with the invention, the nozzle 18 is constructed such that the pattern of water discharged therefrom can be selected so as to direct streams of flushing fluid in preferred directions across the yard so that substantially the whole surface 20 of the yard is washed clean. In the illustrated arrangement, the nozzle 18 produces three major streams 26, 28 and 30 which flow across the yard as will be described hereinafter.

Figure 3:
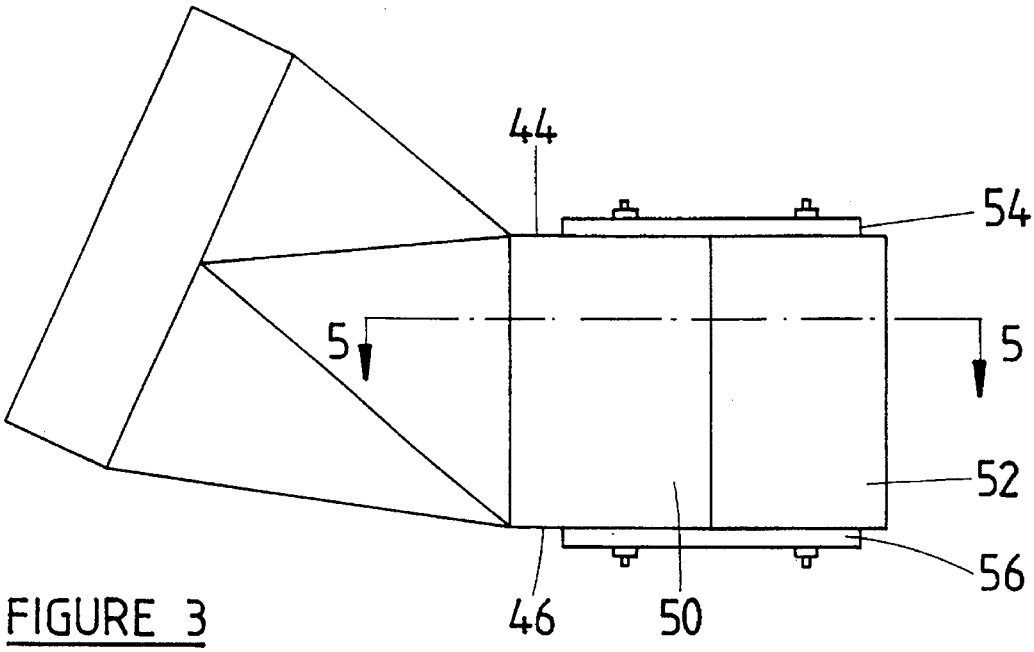
FIG. 3 is a side view of the nozzle of the invention.
Figure 4:
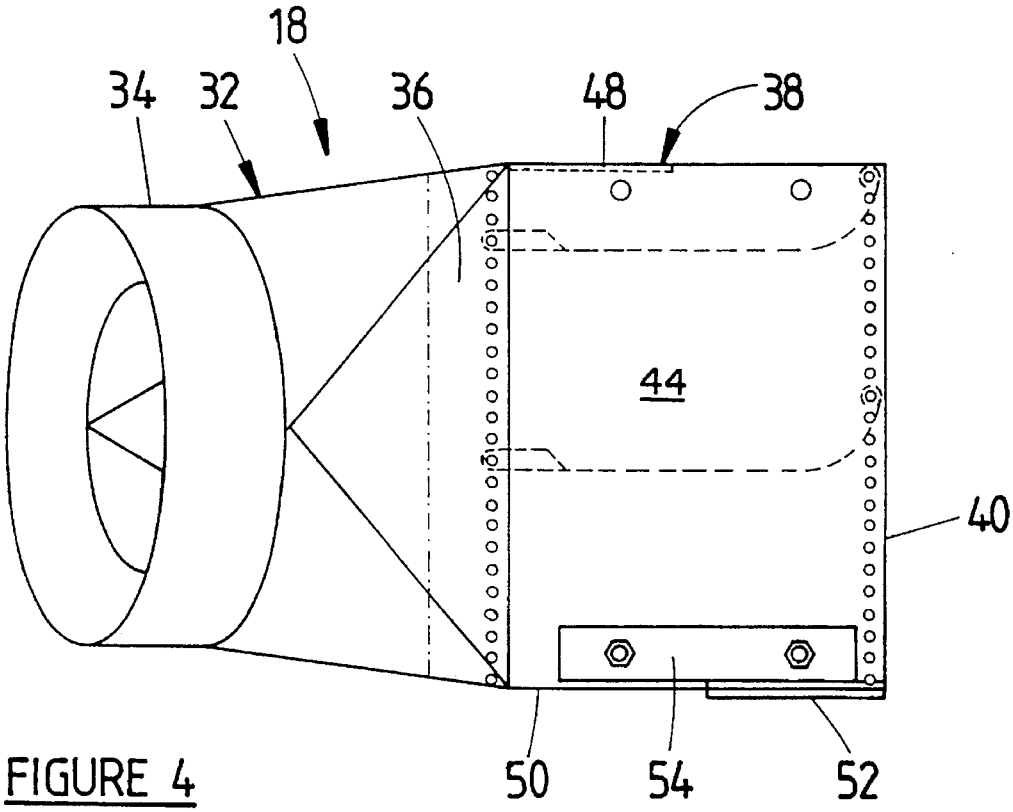
FIG. 4 is a plan view of the nozzle of the invention.
Figure 5:
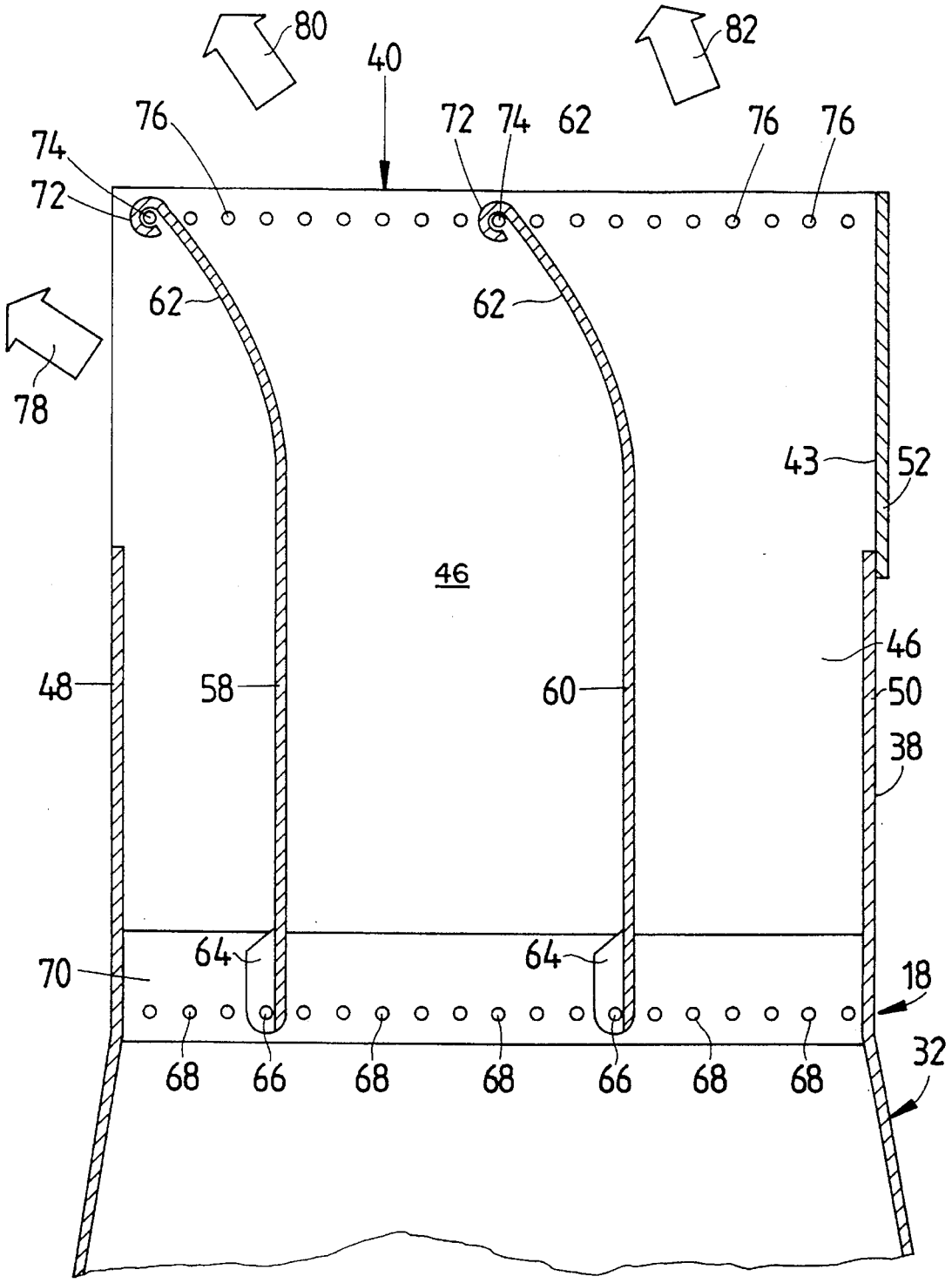
FIG. 5 is a schematic cross-sectional view along the line 5—5.

FIGS. 3, 4 and 5 illustrate one embodiment of a nozzle 18 of the invention. The nozzle includes a transition portion 32 having a circular socket 34 for connection to the lateral branch 16. The forward end 36 of the transition portion 32 is rectangular and is connected to an outlet housing 38. The forward end 36 of the housing 38 is open and constitutes an outlet face 40 of the nozzle. The housing 38 includes top and bottom walls 44 and 46 and opposed sidewalls 48 and 50. The sidewalls 48 and 40 do not extend to the front face 40 of the nozzle so as to define side openings 42 and 43, as best seen in FIG. 5. In the illustrated arrangement, the side opening 43 is closed by means of a side plate 52 which is held in position by upper and lower brackets 54 connected to the top and bottom walls 44 and 46 respectively. The side plate could alternatively be mounted on the other side of the housing to close the opening 42 or a pair of side plates could be provided to close both side openings.

The nozzle of the invention includes a number of baffles mounted therein so as to produce the required outlet streams for flushing the yard. In the illustrated arrangement, the housing 38 includes two baffles 58 and 60. The baffles have curved ends 62 for producing the required outlet water streams. The rear ends of the baffles 58 and 60 are provided with mounting lugs 64 which include bolt holes 66. Screws or bolts (not shown) are used to couple the lugs to selected holes 68 in a mounting plate 70 which extends across the housing between the sidewalls 48 and 50. The forward ends of the baffles 58 and 60 include loops 72 which are used to couple the upper and lower edges of the baffles to the top and bottom walls 44 and 46 by means of bolts 74 which pass through selected holes 76 in the forward edges of the top and bottom walls 44 and 46. The preferred locations of the baffles can be selected in order to achieve optimum results by appropriate selection of the holes 68 and 76, for mounting the nozzles. In the illustrated arrangement, the side opening 42 and the curved end 62 of the baffle 58 will produce a first stream which is directed towards the left (as shown by arrow 78 in FIG. 5). The outlet portion defined between the baffles 58 and 60 will produce a stream which is directed somewhat to the left as indicated by arrow 80 in FIG. 5. The part of the outlet defined by the baffle 60 and the sidewall 50 and plate 52 will produce an outlet stream which is more in line with the longitudinal axis of the nozzle as indicated by arrow 82 in FIG. 5. It will be appreciated that alteration of the number and position of the baffles can vary the direction and relative size of the outlet streams required for a particular yard. The structure of the invention enables the system to be installed and then fine tuned in order to produce the optimum washing result.

The capacity of the system can be varied in accordance with the size of the yard. In a typical installation the top of the tower 8 may be about 3 meters above the level of the surface 20 of the yard. The diameter of the downpipe 14 is preferably in the range 300 mm to 375 mm as is the lateral branch 16. The nozzle 18 may have a smaller cross-sectional area that the downpipe 14 so as to produce a greater flow velocity. For instance the spacing between the top and bottom walls 44 and 46 may be 260 mm and the spacing between the sidewalls 48 and 50 260 mm. The side openings 42 and 43 may be 122 mm from the front face 40 of the housing. With the configuration shown in FIG. 5, the baffles 58 and 60 together with the side opening 42 produce a flow which is directed to the left and forwardly as would be appropriate for the arrangement shown in FIG. 2. In an alternative arrangement where flow to the right were required the baffles could be inverted and the side plate 52 would close the side opening 42 so that fluid could flow to the right through side opening 43.

Many further modifications will be apparent to those skilled in the art without departing from the spirit and scope of the invention.

I claim:

1. A method of flood washing a surface comprising the steps of:

releasing a flushing liquid from a tank, directing the released flushing liquid through a nozzle at a substantial flow rate, the nozzle having an inlet portion in fluid communication with the tank, an outlet portion having an outlet orifice, and at least one baffle mounted within the outlet portion so that the at least one baffle is positioned within the flow path of the flushing liquid flowing through the outlet portion, wherein the shape of the at least one baffle and the outlet portion is such that the at least one baffle can be mounted in different positions in the outlet portion, wherein the outlet portion comprises an outer housing having spaced apart sidewalls and top and bottom walls, an open rear end in fluid communication with the inlet portion, and the outlet orifice comprises an open front end from which the flushing liquid is discharged, and adjusting the at least one baffle to thereby direct flushing liquid issuing from the nozzle in a controlled way so that the flushing liquid flows substantially across the surface.

2. A method as claimed in claim 1, further comprising the steps of forming the released flushing liquid into a plurality of streams so that each stream has a substantial flow rate, and controlling the direction of each of the plurality of streams so that the flushing liquid flows substantially across the entire surface being washed.

3. A nozzle for directing a flushing liquid from a holding tank to a washing surface, including an inlet portion in fluid communication with said flushing liquid holding tank, an outlet portion having an outlet orifice, and at least one baffle mounted within said outlet portion so that said at least one baffle is positioned within the flow path of the flushing liquid flowing through said outlet portion to thereby control the direction in which the flushing liquid flows from said outlet portion, wherein the shape of said at least one baffle and said outlet portion is such that said at least one baffle can be mounted in different positions in said outlet portion, said outlet portion comprising an outer housing having spaced apart sidewalls and top and bottom walls, an open rear end in fluid communication with said inlet portion, said outlet orifice comprising an open front end from which the flushing liquid is discharged.

4. A nozzle as claimed in claim 3, wherein said at least one baffle has bottom and top edges which are locatable adjacent said top and bottom walls, respectively.

5. A nozzle as claimed in claim 3, wherein said at least one baffle is adjustably mounted with respect to said top and bottom walls.

6. A nozzle as claimed in claim 3, wherein said at least one baffle includes a front portion which is curved.

7. A nozzle as claimed in claim 6, wherein said at least one baffle includes a rear portion which is generally planar.

8. A nozzle as claimed in claim 5, further including first and second fixing means for fixing a front end and a rear portion of said at least one baffle to said outlet portion.

9. A nozzle as claimed in claim 8, wherein said first fixing means includes a loop formed along at least part of said forward end of said at least one baffle, said loop being engageable with a bolt which passes through a selected pair of a plurality of pairs of aligned openings in said outlet portion.

10. A nozzle as claimed in claim 9, wherein said second fixing means includes at least one lug provided at said rear portion of said at least one baffle and a plurality of holes at a rear section of said outlet portion so that screws or bolts can be passed through a selected hole to engage said at least one lug.

11. A flood washing system for flood washing a surface or yard, the system comprising:

a flushing liquid holding tank, a downpipe in fluid communication with said flushing liquid holding tank, a valve positioned between said holding tank and said downpipe, and a nozzle coupled to an end of the downpipe for discharging flushing liquid across the surface, said nozzle having an inlet portion in fluid communication with said downpipe, an outlet portion having an outlet orifice, and at least one baffle mounted within said outlet portion so that said at least one baffle is positioned within the flow path of the flushing liquid flowing through said outlet portion, thereby controlling the direction in which the flushing liquid flows from said outlet portion, wherein said at least one baffle and said outlet portion are shaped such that said at least one baffle can be mounted in different positions in said outlet portion, said outlet portion comprising an outer housing having spaced apart sidewalls and top and bottom walls, an open rear end in fluid communication with said inlet portion, wherein said outlet orifice comprises an open front end from which the flushing liquid is discharged.

* * * * *